United States Patent [19]

Pollak, Jr. et al.

[11] Patent Number: 4,682,541

[45] Date of Patent: Jul. 28, 1987

[54] POSTAL MAILING SYSTEM HAVING AN ADAPTABLE POSTAGE METER

[75] Inventors: Philip Pollak, Jr., Westport; Keith E. Schubert, West Norwalk, both of Conn.

[73] Assignee: Pitney Bowes Inc., Stamford, Conn.

[21] Appl. No.: 798,343

[22] Filed: Nov. 7, 1985

Related U.S. Application Data

[63] Continuation of Ser. No. 592,679, Mar. 23, 1984, abandoned.

[51] Int. Cl.[4] ..... B41L 47/46; B41J 1/20

[52] U.S. Cl. ..... 101/91; 101/45

[58] Field of Search ..... 101/45, 91, 99, 106, 101/109, 110; 235/101; 400/692

[56] References Cited

U.S. PATENT DOCUMENTS

| | | | |
|---|---|---|---|
| 2,510,350 | 6/1950 | Rouan et al. | 101/91 |
| 3,133,700 | 5/1964 | Schaerer et al. | 235/101 |
| 4,119,161 | 10/1978 | Price et al. | 235/101 |
| 4,286,144 | 8/1981 | Pollak, Jr. et al. | 235/101 |
| 4,361,753 | 11/1982 | Schubert et al. | 235/101 |
| 4,367,676 | 1/1983 | Clark | 101/91 |
| 4,398,458 | 8/1983 | Denzin et al. | 101/91 |

*Primary Examiner*—Edgar S. Burr
*Assistant Examiner*—David A. Wiecking
*Attorney, Agent, or Firm*—Michael J. DeSha; Albert W. Scribner; William D. Soltow, Jr.

[57] ABSTRACT

A mailing system including a postage meter adaptable to either a high-speed mailing machine capable of parallel postal value selection or a low-speed mailing machine capable of serial value selection is disclosed. The postage meter includes a print drum with printing value members. A rod extends outwardly from the drum. The rod contains linear racks that are axially located above the horizontal centerline of the rod. The linear racks interact with the value members to provide the proper value setting. Attached to the postage meter are a plurality of cross-over shafts with pinion gears. The gears engage the racks to facilitate value selection. In the high-speed mailing machine, a series of drive members engage the shafts. Apparatus within the high-speed mailing machine causes the shafts to rotate in a parallel fashion to allow for postal value selection to facilitate postal printing. In the low-speed mailing machine, one drive member engages on e shaft of the postage meter. Apparatus within the low-speed mailing machine causes the pinion gear to engage a rack to provide the proper print value. The apparatus in the low-speed machine also causes the drum member to rotate so that the other racks can be serially acted upon by that shaft-pinion gear arrangement to provide the proper postal value to facilitate postal printing. In accordance with this embodiment, a locking device is utilized to prevent inadvertent movement of the adjacent rack members when one rack is being adjusted.

2 Claims, 11 Drawing Figures

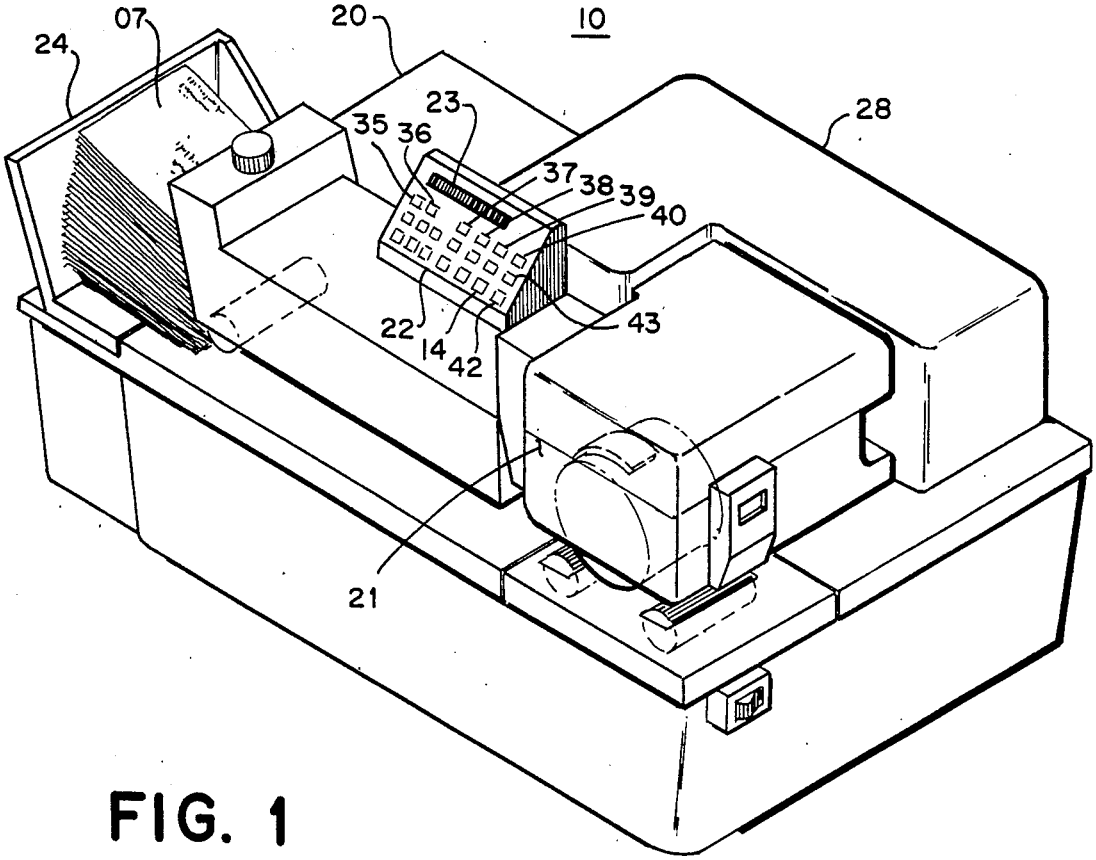
FIG. 1
FIG. 2
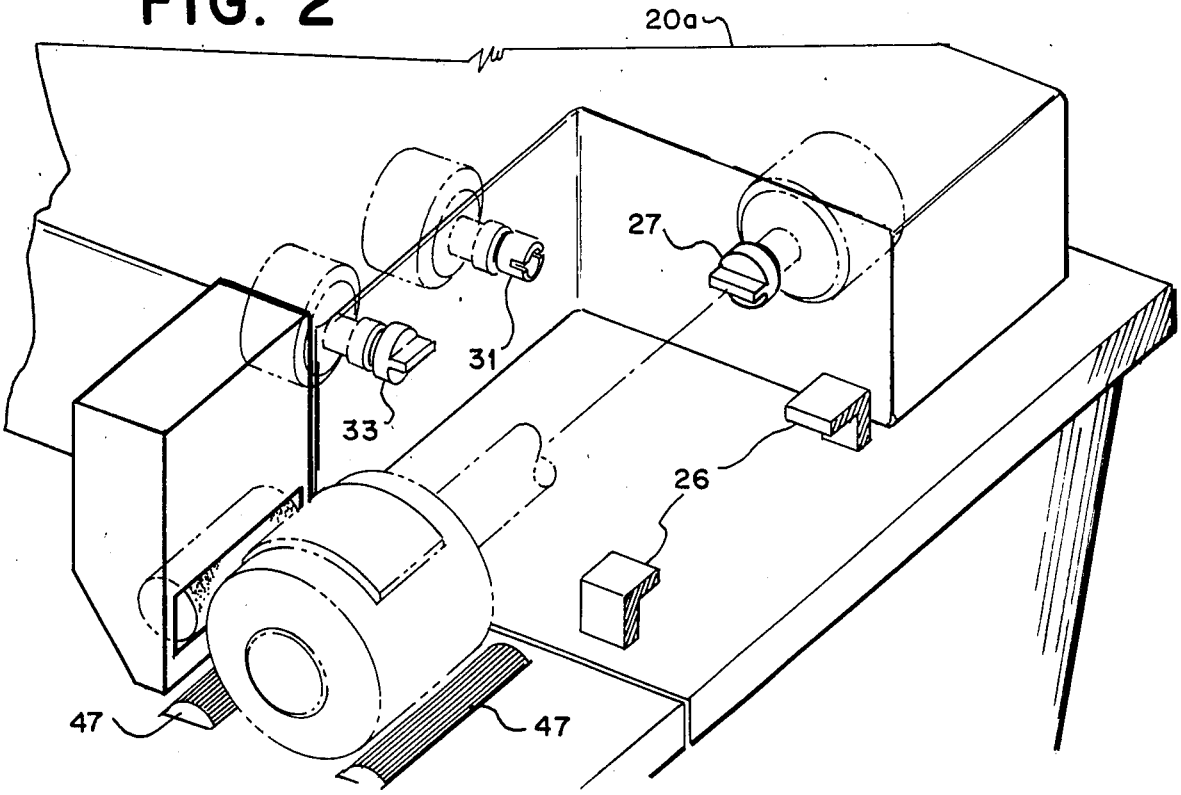

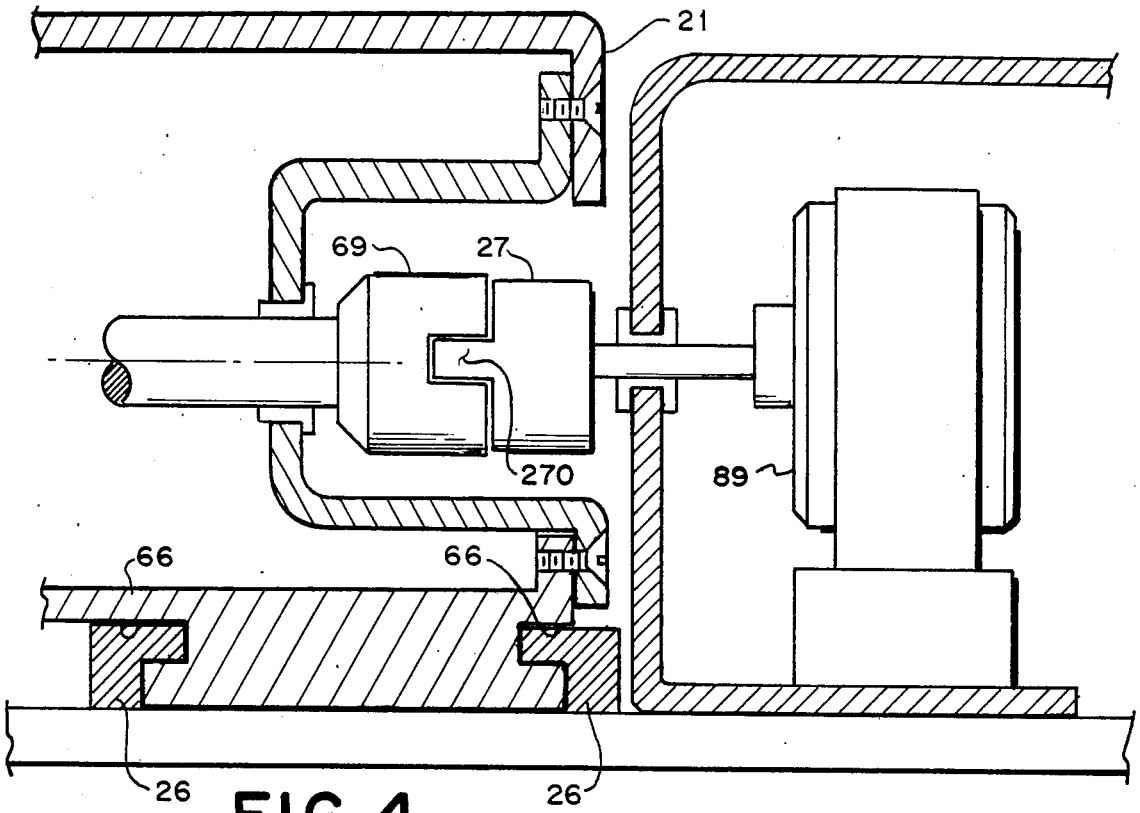
FIG. 4
FIG. 3
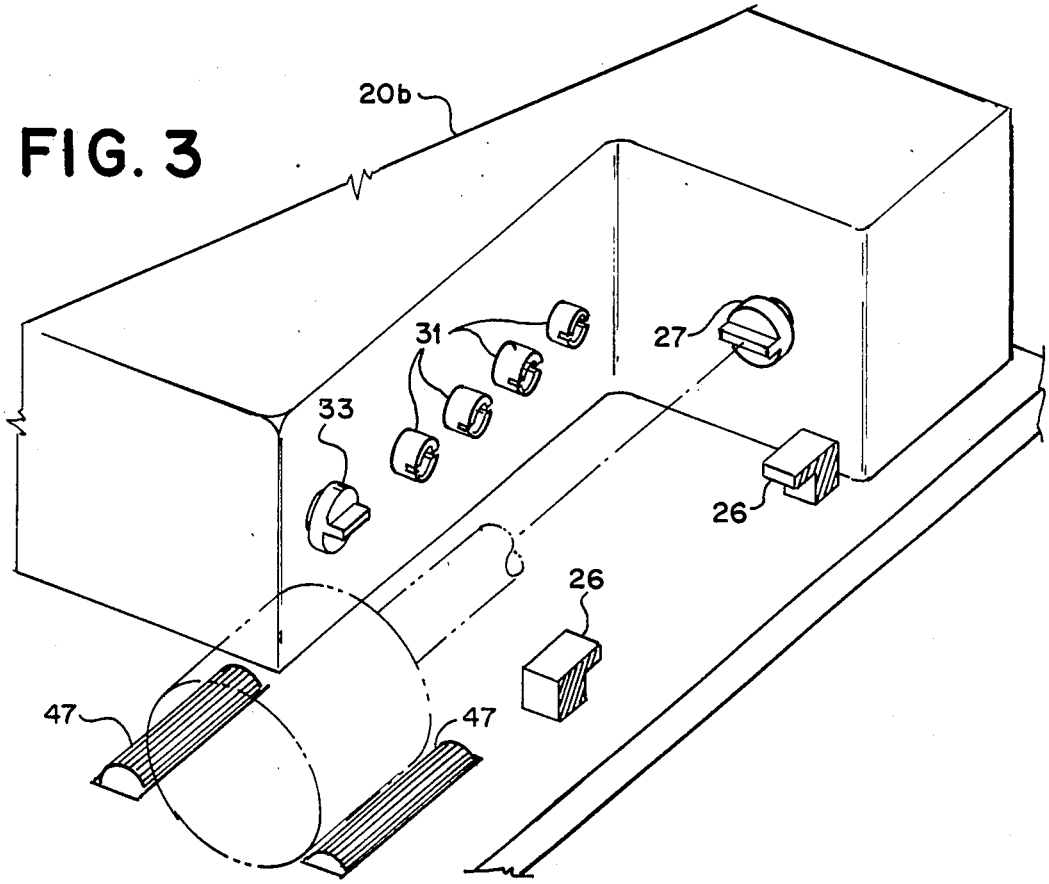

POSTAL MAILING SYSTEM HAVING AN ADAPTABLE POSTAGE METER

This application is a continuation, of application Ser. No. 592,679, filed 3/23/84, now abandoned.

FIELD OF THE INVENTION

This invention relates to mailing systems and more particularly to a postage meter that will be adaptable to either a high-speed or low-speed mailing system.

CROSS REFERENCE TO RELATED APPLICATION

Reference is made to U.S. patent application Ser. No. 592,680 entitled A ROTARY SHUTTER DEVICE FOR A POSTAL MAILING SYSTEM, filed concurrently herewith.

BACKGROUND OF THE INVENTION

Postage meters are devices for dispensing value in the form of postage printed on a mail piece such as an envelope. The term "postage meter" also includes other similar meters such as parcel post meters. A postage meter which is typically used is described in U.S. Pat. No. 4,301,507 issued on Nov. 17, 1981 in the name of John H. Soderberg, Alton B. Eckert and Robert B. McFiggans assigned to the assignee of this application. Meters of this type print and account for postage stored in the meter. Mechanisms are provided in the meter to set a particular value of postage to be printed on a mail piece.

Associated with postage meters are mailing machines. Mailing machines can typically be high-speed (that is, a system where the value selection function is done simultaneously or, in the alternative, a mailing machine can be of the low-speed variety (that is, that each print wheel on a value selection drum of the postage meter is serially selected to allow for the printing of the postage stamp on the envelope or package). Typically, the low-speed machine is cheaper but does not handle mail as rapidly as the high-speed system.

Also associated with mailing systems are meter resetting devices. These devices are often times utilized to set the appropriate postal value.

Postage meters have been developed with electronic accounting systems which has led to the development of printing mechanisms and value setting mechanisms which cooperate with electronic systems in a manner to enhance the capability of the postage meter. Typically, a postage mailing system comprises a postage meter such as the beforementioned Soderberg et al patent with appropriate electronic control circuitry and a mailing machine which conveys the envelopes along a path to a receptacle. Mailing systems have become highly automated and are capable of processing large numbers of envelopes at a high rate of speed. It is important therefore that a postage meter can be associated with a high-speed mailing machine or a low-speed mailing machine to allow for universal application.

Heretofore, the combination of the meter and mailing machine have been uniquely adapted; that is, a postage meter was configured in such a way that it was only suited to be mated to a particular mailing machine or a particular set of mailing machines. Thus, a high-speed mailing system was only suitable for use for a postage meter which had mating elements adapted thereto. Conversely, a low-speed mailing machine was suitable only to be connected to a postage meter that had mating elements adapted thereto.

Therefore, it is clear that a universal postage mailing system, that is, a system which will allow for a postage meter to be adaptable to a high-speed machine (parallel value selection) or a low-speed mailing (serial value selection) is desirable. It is important that the system be a simple alternative to existing mailing systems. It is also important that the system be a dependable one and be subject to only minimal adaptations as compared to existing systems.

SUMMARY OF THE INVENTION

A universal postage mailing system is disclosed in the present invention. The system is such that a postage meter can be attached to either a low-speed mailing machine capable of serial value selection or a high-speed mailing machine capable of parallel value selection.

In a first embodiment, the system comprises a mailing machine including apparatus to control the various movements of the postage meter for value selection. The mailing machine of this embodiment includes a plurality of drive members located at an outwardly facing side surface of the machine. The postage meter includes plurality of cross-over shafts with pinion gears on one end and a plurality of linear racks located within the same longitudinal plane and in mateable engagement with the other end of the shafts. The shafts engage the drive members of the mailing machine. The linear racks, in turn, extend into a drum member and are located along the axial length of a rod member. The rod member extends into the drum member and supports the racks. The other end of the racks mateably engage print wheel elements located within the drum member.

In response to signals from the apparatus from the mailing machine, the drive member shifts respective racks simultaneously. These racks, in turn, move the print wheel elements to correspond to the proper amount of postage value. This embodiment describes the high-speed mailing system with a postage meter adapted thereto.

In a second embodiment, the postage meter is utilized with a mailing machine that has only one drive member located on the outwardly facing side surface. As in the first embodiment, one shaft engages the drive member of the mailing machine. The drive member in response to apparatus in the mailing machine shifts a rack member. Thereafter, the mailing machine's apparatus causes the print drum to rotate and the next rack member is adjusted. The above action is repeated until all of the racks have adjusted the print wheels to their respective print values. Thus, in this embodiment, the postage meter has been adapted to a low-speed mailing machine.

In the second embodiment, a locking device located around the rod member can be utilized to allow for the adjustment of one rack member and at the same time prevent the inadvertent movement of any other rack members located within the rod member. This device comprises a planar section that surrounds the rod member. Within the planar section is a slotted opening that is one rack member wide.

This universal mailing system allows for a single postage meter to be adaptable to either high- or low-speed mailing machines. In so doing, a postage meter can be utilized which is simpler and more uniform than has heretofore been accomplished.

BRIEF DESCRIPTION OF THE DRAWINGS

FIG. 1 is a perspective view of a postal mailing system,

FIG. 2 is a perspective view of a cut-away portion of a low-speed mailing machine, FIG. 3 is a perspective view of a cut-away portion of a high-speed mailing machine, FIG. 4 is a cross-sectional view of the postage meter being attached to a mailing machine.

DETAILED DESCRIPTION

Figure 5:
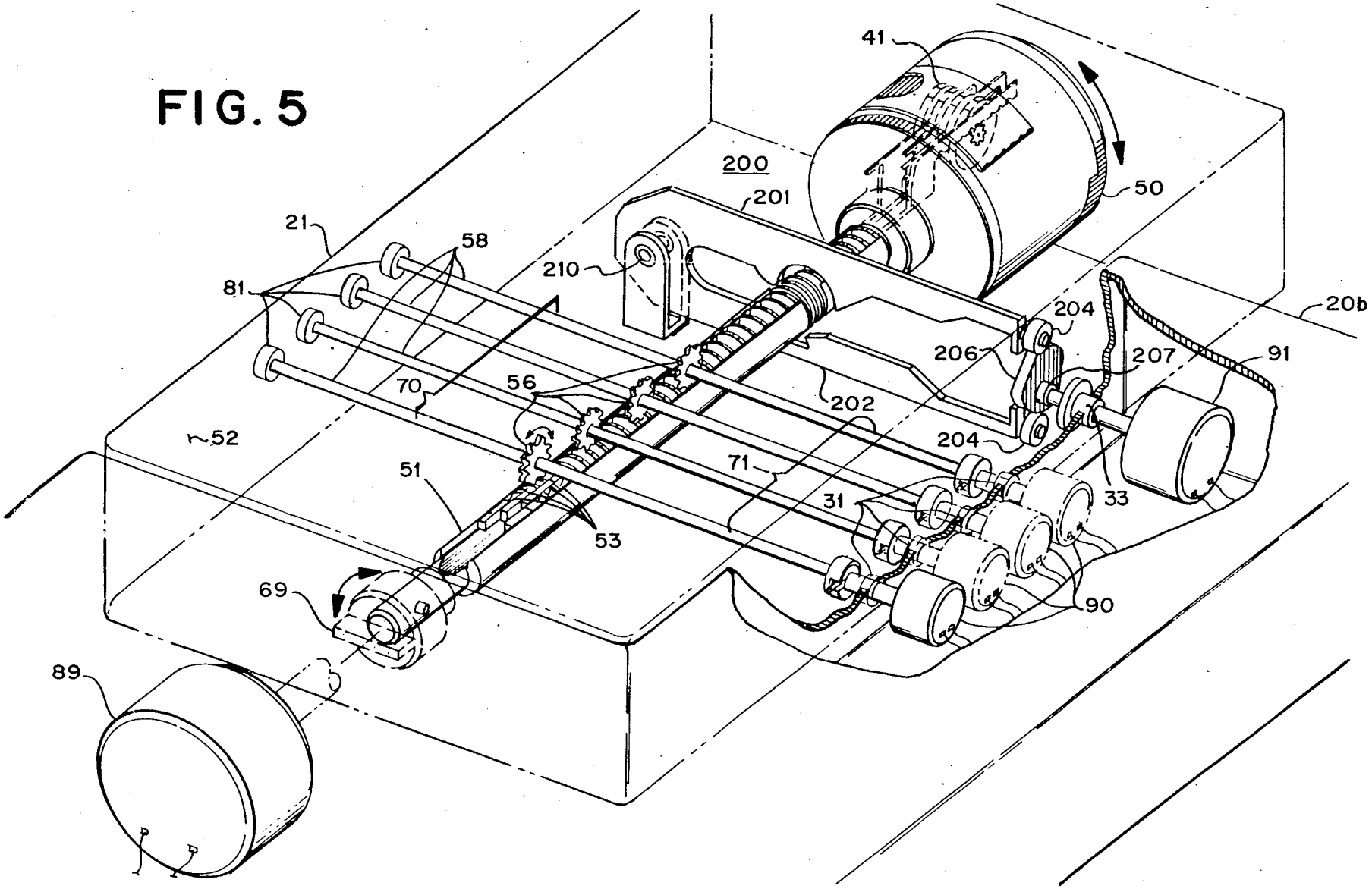
FIG. 5 is a cut-away view of the mailing machine of FIG. 3 attachably connected to a postage meter to form a high-speed mailing system.

FIG. 1 shows a perspective view of a mailing system 10. The mailing system 10 typically comprises the mailing machine 20 and a postage meter 21. The mailing machine 20 of this embodiment has a panel 22 at a top portion. The panel 22 contains a set of keys that can perform a variety of functions. The postage meter contains ascending and descending registers which perform their normal functions. Thus, the ascending register will give a running total of the printed postage and the descending register will inform an operator of the amount of postage funds still remaining in the meter. Keys 35 and 36 can be utilized to display these amounts respectively on display 23 to allow the operator to monitor those respective values as well as perform other functions. Further, keys 37–40 may enable display in a conventional manner of other specific specialized values such as control or postage sum, piece count, batch value and batch count, respectively.

Also, the panel is provided with numeric setting keys 14 and a decimal key 42 operative therewith for setting the meter to print a desired amount of postage, the amount normally being displayed on the display 23. When the displayed amount has been set to the desired value, depression of a set postage key 43 effects the setting of postage meter's 21 apparatus. The mailing machine 20 also includes the feeder 24 for separating and feeding the envelopes 7 associated with the mailing machine. Electromechanical apparatus is located within enclosure 28 of the mailing machine 20 to operate the postage meter 21. Thus, in this system, there is apparatus or circuitry within the mailing machine 20 that would set the various operations of the postage meter 21. In the instant invention, the mailing machine 20 could be of the low-speed or high-speed variety depending upon the apparatus or circuitry located therein.

Looking at FIGS. 2 and 3, there are shown in cut-away view portions, the respective mailing machines 20*a* and 20*b* (high- and low-speed) with the postage meter 21 removed. As is readily apparent by viewing the two figures, each machine has as common elements latching members 26 and main gear 27. The latching members 26 cooperate to secure the postage meter 21 in its proper position on the mailing machine. As can be seen from cross-sectional view of FIG. 4, the body of the postage meter 21 has slots 66 that will engage the latching members 26. In addition, in the rear of the postage meter 21 is slotted member 69 for engaging the projection 270 of master gear 27 when the postage meter 21 is properly positioned on the mailing machine. The main gear 27 through the slotted member 69 turns a print drum located within the postage meter 21 to imprint postage and/or move the drum incremental distances. Also common to FIGS. 2 and 3, are rollers 47 for positioning the envelope (not shown) under the postage meter 21 (FIG. 1).

Finally, also common to the mailing machines 20*a* and 20*b* (FIGS. 2 and 3) is shutter drive member 33. The shutter drive member 33 provides the means for preventing unauthorized movement of the print values located within the postage meter 20. The shutter drive member 33 is also utilized to prevent unauthorized movement of the print drum of the postage meter.

A major difference between the mailing machines 20*a* and 20*b* in FIGS. 2 and 3 are in the number of drive members 31. As can be seen, the low-speed mailing machine 20*a* of FIG. 2 has only one of these drive members 31 while the high-speed mailing machine 20*b* of FIG. 3 has several; in this case, four of the drive members 31. Another difference between the mailing machines 20*a* and 20*b* is that in the mailing machine of FIG. 2, the various postal value digits are selected in a serial fashion while in the mailing machine of FIG. 3, the postal value digits are selected in a parallel or simultaneous fashion.

In the present invention, the same postage meter can be connected to either of the mailing machines 20*a* and 20*b* of FIGS. 2 and 3. Thus, what is disclosed is a mailing system that is universal. That is, the system allows for a postage meter which can be attached to a mailing machine which would provide simultaneous or parallel setting of the print values (high-speed) as in FIG. 3 and the meter can also be attached to a machine which provides a serial setting of the print values (low-speed) as in FIG. 2. The interaction of the postage meter with each of the mailing machines in FIGS. 2 and 3 will be shown in more detail by the remaining figures in association with the following discussion.

Associated with the interior of the mailing machines 20*a* and 20*b* are electromechanical means 90 (not shown) for controlling the drive members 31. The electromechanical means can be stepper motors or the like which are extensively used and well known in the art. The controlling means will cause the drive members 31 to rotate in response to the signals produced by the panel 22 (FIG. 1) of the mailing machine. In addition, the main gear 27 of either mailing machine is also actuated by the controlling means for rotating a drum member of the postage meter as will be hereinafter described. As before discussed, this rotation of the drum member can either be for incremental movement of the drum member for value selection or full rotation to print the postal value on to a envelope located within the mailing machine.

Referring to FIG. 5, the postage meter 21 includes a drum member 50 with print wheel value members 41 located interior thereto. In this embodiment, there are four value members 41. These value members 41 would correspond to $99.99 thereby allowing up to $100 of postage to be imprinted on an envelope. It is clear, however, that the number of print value members 41 is not limited to four for one ordinarily skilled in the art to practice our invention.

Also connected to the drum member 50 is circular rod member 51. Rod member 51 extends into the interior of drum member 50. The rod member 51 contains a plurality of rack members 53 which interact with the print value members 41 to provide a mechanism for rotating the value members 41.

As is seen from FIG. 5, the teeth of the rack member 53 engage the gears of the respective value members 41 to provide for the movement of the value members 41. Rack members 53 extend axially along the entire length of the rod member 51. The rack members 53 of the present invention are all located in the same longitudinal plane. The rack members 53 are also located in a position above the horizontal center line of the rod member 51 to provide easy access thereto.

The other end of rod member 51 is connected to a receiving member 69 which engages the main gear 27 within the mailing machine. Attached across to the wall 52 of the postage meter 21 and across the rack members 53 are a plurality of cross over shaft gear assemblies 58. In this embodiment, there are four assemblies 58 to respectively engage the four rack members 53 located within the rod member 51.

The wall 52 has a set of openings 81 to accommodate a shaft portion 70 of the gear assemblies 58 such that the gear assemblies 58 can rotate freely at that end. The other end of each gear assembly 58 has a shaft member 71 that is adapted to be attached to the drive members 31 of the mailing machine 21. There is a pinion gear 56 also associated with each shaft that engages the rack members 53. The postage meter 21, by the configuration of the shaft gear assemblies 58 allows for adaptation of the meter to either a high-speed or low-speed mailing machine.

The following discussion will describe how the postage meter 21 is utilized with first, a high-speed mailing machine **20*b* and then second, with a low-speed mailing machine 20*a* to show a universal mailing system. FIG. 5 depicts a cut-away view of the postage meter attached to a high-speed mailing machine 20*b*. As can be seen in FIG. 5, the drive members 31 of the high-speed mailing machine engage all four of the gear assemblies 58 of the postage meter 21. When the keyboard 22 (FIG. 1) of the mailing machine 20*b* sets the postal value to be imprinted, the drive members 31 rotate the shafts 58 such that the rack members 53 rotate the print wheel value members 41 to their proper positions. In the high-speed mailing machine 20*b*, this activity is done in a parallel or simultaneous fashion thereby facilitating a more rapid setting of the value members 41**.

The electromechanical apparatus within the mailing machine 20 may be stepper motors 90 to perform the parallel movement of the rack members 53 by the gear assemblies 58. Thereafter, the mailing machine **20*b* will actuate the main gear 27 through motor 89 to rotate the drum member to place its imprint of that print value on the envelope (not shown) being conveyed across the rollers 47 (FIG. 1**).

Figure 6:
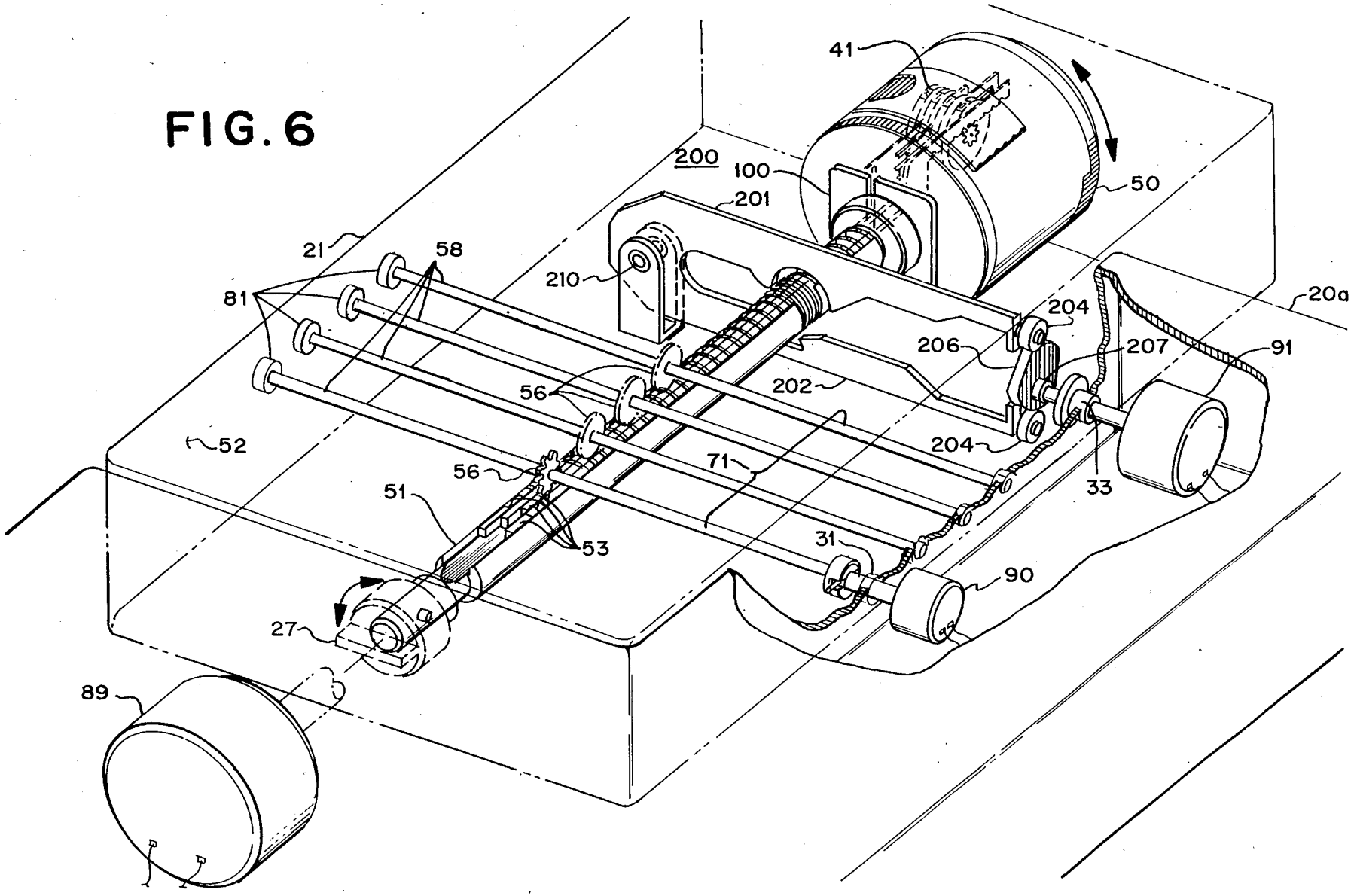
FIG. 6 is a cut-away view of the mailing machine of FIG. 2 attachably connected to the postage meter of FIG. 4 to form a low-speed mailing system.

Referring to FIG. 6, a cut-away view perspective, the same postage meter is attached to a mailing machine **20*a* with only one drive member 31 (i.e., the low-speed mailing machine). In this embodiment, the drive member 31 engages one gear assembly 58 preferably the assembly closest to the drive member 31 as shown in the figure. In this manner, the drum 50** only has to rotate in one direction to facilitate value selection.

When the keyboard 23 (FIG. 1) sets the postal value to be applied to the envelope, the drive member 31 adjusts the first print value member 58 and the electromechanical apparatus within the mailing machine **20*a*, in this case, one stepper motor 89, causes the main gear 27 to rotate the drum member one incremental space to the next adjacent rack member 53. The drive member 31 then adjusts that rack member 53 to the proper print wheel value and so on and so forth until all four rack members 53 are adjusted until the value members 41 reach their proper values. After these adjustments are made, the stepper motor 89 within the mailing machine 20*a* causes the main gear 27 to rotate the drum member 50 over an envelope (not shown) to print the postal values thereon. In the low-speed mailing machine 20*a*, therefore, there is serial adjustment of each rack member 53. This adjustment would be slower than the adjustment made with a high-speed mailing machine 20*b* of FIG. 4 because, as before described, the high-speed mailing machine 20*b* adjusts the rack members 53** simultaneously.

Figure 7:
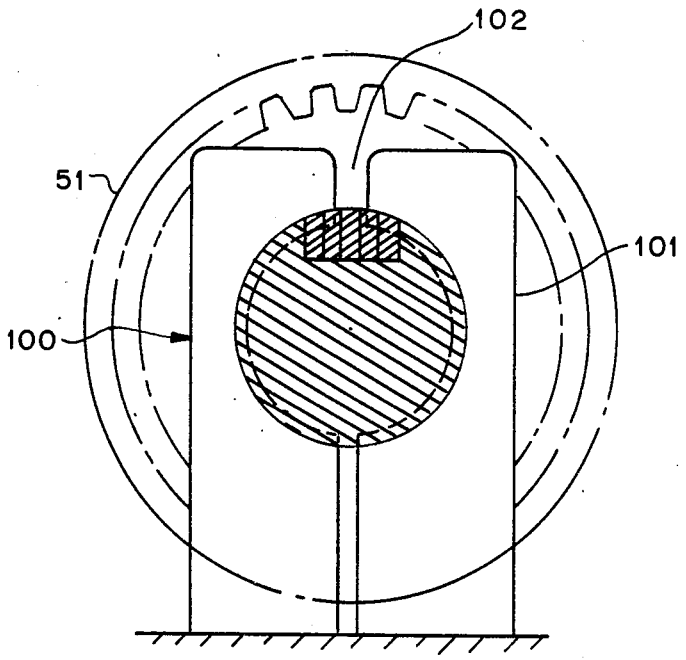
FIG. 7 is a cross-sectional view of a locking device utilized in connection with the mailing system of FIG. 6.

During serial selection, the rack member 53 adjacent to one that is being adjusted can be inadvertently pulled along when the adjusted rack member 53 moves to its final position. This can cause problems in that incorrect postal value setting may result through this inadvertent movement. As a further refinement of Applicant's invention for use with the mailing machine **20*a* of FIG. 6, there is a locking device 100 advantageously placed around the rod member 51 of the postage meter 21. The locking device 100 is stationary with respect to the drum member 50 to lock out all but the rack member 53 that is being adjusted. The locking device 100 shown in cross-sectional view in FIG. 7 comprises a planar member 101 which surrounds the rack members 53 whereby a slotted opening 102 that is one rack member 53 wide is shown therein. The slotted opening 102 allows one rack member 53 to move and prevents the other rack members 53 from moving. The locking device 100 as hereinabove described, prevents in a serial selection system the inadvertent movement of adjacent rack members 53** when one is being adjusted.

A feature common to the mailing system of FIGS. 5 and 6 is the rotary shutter member 200. A shutter bar arrangement is used typically in most mailing machines to prevent unintended tampering of the mailing machines. The shutter member 200 is similarly utilized in this system to prevent unauthorized movement of the drum 50 and also to prevent unauthorized adjustment of the rack members 53 while the postage meter is in place on the mailing machine.

The shutter member 200 comprises a first and second bar members 201 and 202. Bar members 201 and 202 surround rod members 51 and are attachably connected at one end to each other by pin 210. The pin is attached to a hinge 203 which, in turn, is attached to the housing of postage meter 21. The other ends of the bar members 201 and 202 have follower members 204 which ride on a cam 206. The cam 206 has a shaft 207 which is adapted to be attached to shutter drive member 33 of the mailing machine. The shutter drive member 33, in turn, is actuated by stepper motor 91.

Figure 8:
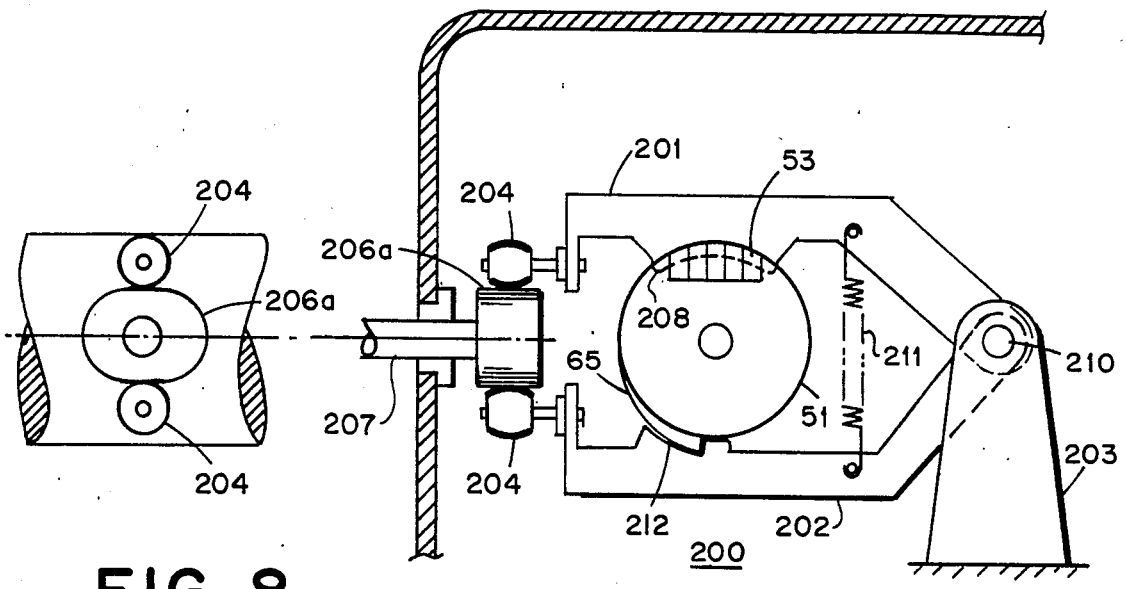
FIG. 8 is a cross-sectional view of a first embodiment of a rotary shutter bar.

FIG. 8 shows in a cross-sectional, cut-away view, one embodiment of shutter member 200. As is seen in the figure, oblong cam **206*a* is rotated in a position such that the follower members are located at a point closest to each other. The spring 211 causes tension upon the bar members 201 and 202 to keep them biased together. Bar member 201 has a semi-circular flange 208 to lock the rack members 53 in place. Bar member 202 has a detent 212 that engages a fin-like flange 65 located on rod member 51. Thus, in this position, the rack members 53 are locked in place and the drum member 50** is prevented from rotating.

Figure 9:
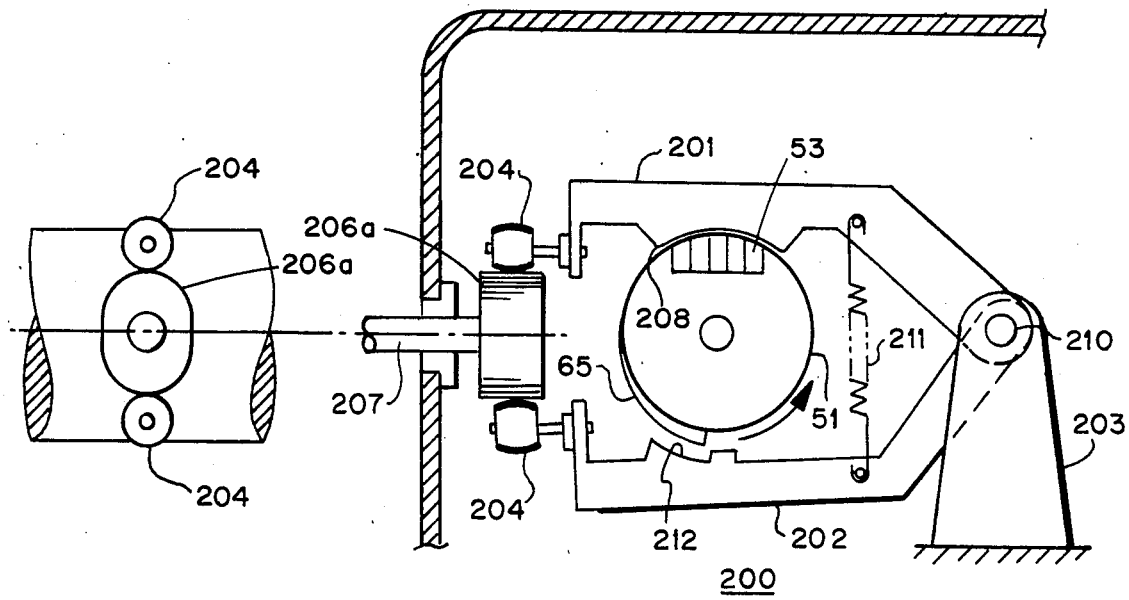
FIG. 9 is the same view as FIG. 8 with the shutter being rotated to a second position.

When the gear 27 (FIGS. 4 and 5) and therefore the cam 206*a* is rotated as shown in FIG. 9 to a second position, the follower members 204 are spread apart by the cam 206*a* so that the rack members 53 are unlocked by flange 208 and the flange 65 is disengaged from detent 212. Thus, in this position, the rack members 53 can be adjusted and the drum 50 can be rotated.

Therefore, in this embodiment, when the main gear 27 is in a first position, no movement can take place. When the gear 27 is moved by a stepper motor or the like to a second position both drum rotation and rack movement can take place.

Figure 10:
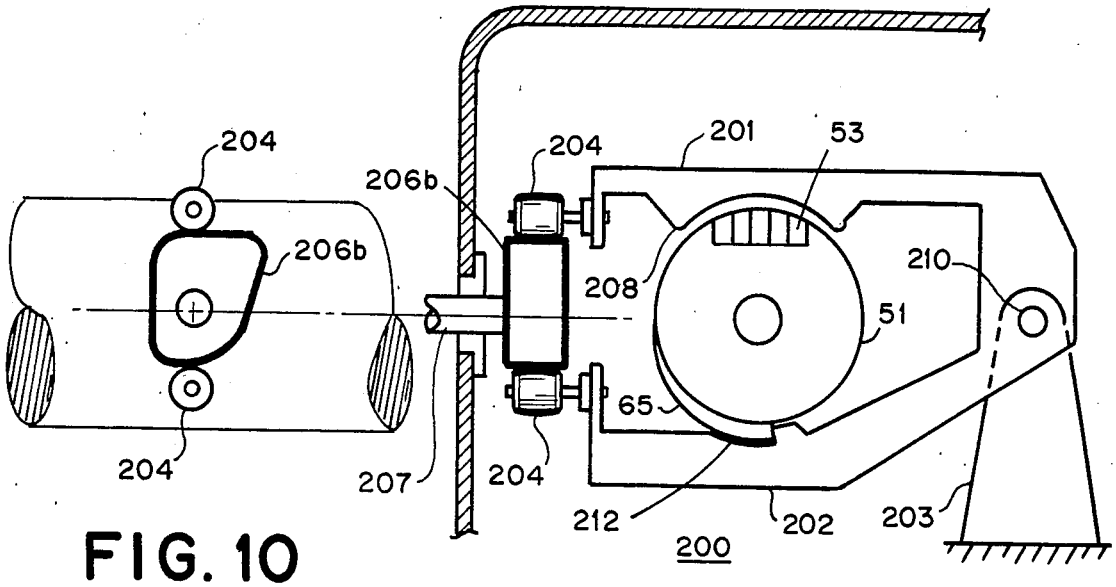
FIG. 10 is a cross-sectional view of a second embodiment of a rotary shutter in a first position.
Figure 11:
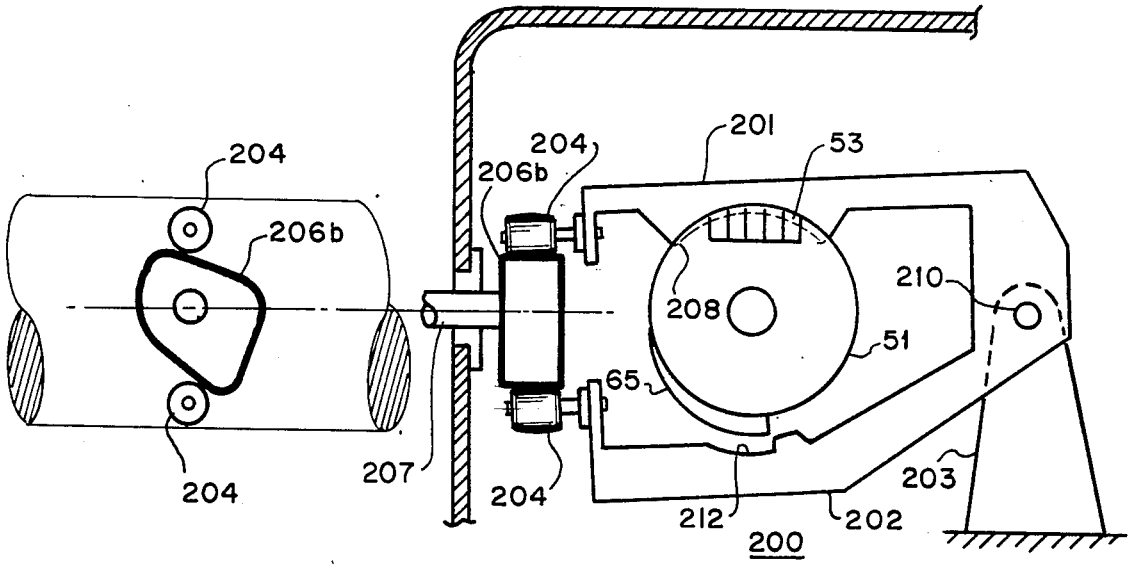
FIG. 11 is the same view as FIG. 10 with the shutter being rotated to a second position.

A second embodiment of a rotary shutter member 200 is shown in FIGS. 10 and 11. The members that comprise this shutter member 200 are virtually identical to that of FIGS. 8 and 9, with two exceptions: (1) the spring 211 is not used and (2) the cam member 206*b* is of an irregular configuration. Thus, as can be seen by referring to FIG. 10, when the irregularly shaped cam 206*b* is in a first position, the rack members are unlocked but the rod member can't rotate because of the engagement of the flange 65 with the bar member. When the irregularly shaped cam 206*b* is rotated by the shutter drive member (FIG. 5) to the position as shown in FIG. 11, the rack members 53 are locked in place but the drum member 50 can be rotated because the flange 65 is no longer held by the detent 212 of bar member 202.

Thus, in this embodiment, the shutter member 200 in each of the two positions would allow one or the other of the actions to occur. That is, in the first position, the rack members 53 can be adjusted and in the second position, only the drum member 50 can be rotated.

It is clear that either of these embodiments of rotary shutter member 200 could be utilized in the postage meters 21 that have been before described to prevent unauthorized movement of the drum member 50 and rack members 53.

It is known and understood that the term postage meter, as used herein, refers to the general definition of a device for the imprinting of a defined unit value for governmental or private carrier parcel, envelope or package delivery, or other like application for unit value printing. Thus, although the term postage meter is utilized, it is both known and employed in the trade as a general term for devices utilized in conjunction with services other than those exclusively employed by governmental postal services. For example, private parcel or freight services purchase and employ postage meters as a means to provide unit value pricing for individual parcels, including accounting and printing functions.

The above-described examples of mailing systems can be modified in a variety of ways and those modifications would still be within the spirit and scope of Applicants' invention. For example, the number of drive members and gear and shaft assemblies could be of any number and should not be limited to the specific number utilized to describe the invention. Thus, while this invention has been disclosed by means of specific illustrative embodiments, the principles thereof are capable of a wide range of modification by those skilled in the art within the scope of the following claims.

What is claimed is:

1. A postal metering system comprising a postage meter adapted to be connected to a low-speed mailing machine wherein the low-speed mailing machine includes one receiving member extending outwardly from its surface, the low-speed mailing machine having means for controlling the one receiving member, the postage meter of this system comprising; a print drum member, a plurality of rotatable print value members located within the drum member, a rod member extending into the drum member, the rod member having a plurality of rack members located axially therein, the rack members being located within the same longitudinal plane, one end of the rack members engaging each of the value members, a plurality of crossover shaft members extending perpendicularly across the rod member, each of the plurality of shaft members having a gear located therein, each gear engaging one of the plurality of rack members, one of the shaft members engaged by the one receiving member of the mailing machine receiving member when the postage meter is attached to the low-speed mailing machine, the controlling means comprising means for rotating the drum member to align each rack member with the gear being actuated by the one receiving member for serial setting of the print value members.

2. A postal mailing system comprising: a mailing machine, the mailing machine comprising receiving means extending outwardly from an outside surface of the mailing machine, and means within the mailing machine for controlling the receiving means, the receiving means comprising a drive member, the postage meter comprising a drum member for printing, the drum meter including print value members located there within, a rod member coupled to the drum member, the rod member having a plurality of racks located axially within the rod member, the racks also being located within the same longitudinal plane, the racks also being mateably engaged with the print value members of the drum member, a plurality of crossover shaft members that extend perpendicular over the rod member, each of the plurality of shaft members having a gear located thereon, each gear being in mateable engagement with one of the racks, the receiving means of the mailing machine being coupled to the shaft members, the controlling means comprising means for rotating the drum member to align each rack member with the gear being actuated by the one drive member in a sequential manner.

* * * * *